US006438791B1

(12) United States Patent
Burns

(10) Patent No.: US 6,438,791 B1
(45) Date of Patent: Aug. 27, 2002

(54) MULTI-PURPOSE CLEANING BUCKET

(76) Inventor: Philip J. Burns, 12 Bradford St., Duxbury, MA (US) 02332

( * ) Notice: Subject to any disclaimer, the term of this patent is extended or adjusted under 35 U.S.C. 154(b) by 0 days.

(21) Appl. No.: 09/443,532

(22) Filed: Nov. 19, 1999

(51) Int. Cl.[7] ..... A47L 13/58
(52) U.S. Cl. ..... 15/264; 15/260
(58) Field of Search ..... 15/264, 260, 261, 15/262, 263; 220/604

(56) References Cited

U.S. PATENT DOCUMENTS

| | | | | |
|---|---|---|---|---|
| 143,959 | A | | 10/1873 | Brown |
| 413,526 | A | * | 10/1889 | Light |
| 475,429 | A | | 5/1892 | Zeiser |
| 1,488,930 | A | | 4/1924 | Mannix |
| 1,512,744 | A | | 10/1924 | Calder |
| 1,570,892 | A | | 1/1926 | Hill |
| 2,712,668 | A | | 7/1955 | Thiele |
| 2,757,405 | A | | 8/1956 | Edwards |
| 3,555,589 | A | * | 1/1971 | Quimby |
| 3,630,369 | A | * | 12/1971 | Nichols ..... 15/264 |
| 4,751,763 | A | | 6/1988 | Rose et al. |
| 4,798,307 | A | | 1/1989 | Evrard |
| 4,878,264 | A | | 11/1989 | Young |
| 5,971,199 | A | * | 10/1999 | Jackson et al. ..... 15/264 |
| 6,000,094 | A | * | 12/1999 | Young ..... 15/264 |

* cited by examiner

*Primary Examiner*—Gary K. Graham
(74) *Attorney, Agent, or Firm*—Arthur A. Smith, Jr.

(57) ABSTRACT

A multi-purpose bucket for cleaning surfaces such as windows, comprising a flexible diaphragm, having a slit through the middle, and fitted into the bucket to create a compartment for storing dirt and grit residue from the cleaning instruments; a strap arranged around the inside circumference of the bucket to create receptacles for storing the cleaning instruments; and a tapered wringer affixed to the inside of the bucket for cleaning a scrubber through insertion of the scrubber into the wringer and pushing and pulling the scrubber, causing a twisting motion; and a slit in the side of the bucket which is used to clean a chamois.

3 Claims, 4 Drawing Sheets

MULTI-PURPOSE CLEANING BUCKET

BACKGROUND OF THE INVENTION

This invention relates to a multi-purpose bucket or container used for cleaning glass or plastic surfaces, especially windows. Cleaning liquid is taken from the bucket by an instrument such as a scrubber or chamois, applied to the surface and returned to the bucket by wringing or squeezing the cleaning instrument. The liquid is then re-used.

Of major concern in the prior art is the residue of dirt or grit which is deposited in the cleaning bucket when the cleaning liquid is returned to the bucket by wringing the chamois or squeezing the sponge, scrubber or other instrument. When the cleaning instrument is dipped back into the liquid within the bucket the liquid is agitated, depositing particles of dirt or grit onto the instrument along with the cleaning liquid. When the cleaning instrument is reapplied to the surface being cleaned, the dirt or grit is redeposited onto the surface. As the cleaning process continues, the liquid in the bucket becomes more contaminated and more dirt or grit is redeposited upon the surface being cleaned. The resulting process is inefficient and wasteful of the cleaning liquid which, of necessity, must be changed with such frequency that the cleaning liquid is not used to its full capacity.

Various attempts to solve this problem have been made in the prior art. For example, Rose, et al, use a Mop Bucket Insert U.S. Pat. No. 4,751,763 which is supported on a platform within the mop bucket, creating a compartment under the insert. The insert itself comprises an imperforate platform with a top and bottom surface. When the mop is pushed up and down on the imperforate platform, residue enters the lower compartment. The walls of the insert contain perforations designed to allow solids to enter the lower compartment. Although Rose, et al represents an improvement over other prior art, it is cumbersome and inefficient. The action of pushing the mop up and down on the imperforate platform causes the dirt and grit to be pushed against the perforations. While some particles will exit through the perforations into the lower compartments, the majority will be trapped within the liquid covering the insert due to the vigorous pushing and pulling action needed to clean the mop. This action, in turn, will itself cause mixing forces within the compartment, which will return some particles back into the insert through the perforations. Additionally, the device is too cumbersome to be used for window cleaning, especially at above ground-level heights. The invention of Rose, et al appears specifically designed for a mop or other similar instrument and for cleaning floors or other horizontal surfaces.

Likewise, the Cleaning Equipment invention of Young U.S. Pat. No. 4,878,264 is unsuitable for efficient window cleaning operations. Young employs a passive dirt trap comprised of a fibrous pad section, a lower filter layer section and an upper two-dimensional surface array of closely spaced fronds. As described and claimed, dirt particles settle into the inter-fiber spaces of the pad section, while the fronds, when the disturbance of cleaning the instrument causes agitation of the liquid, lie down more or less flat against the top of the pad section, apparently in an attempt to retain the dirt particles within the pad section. The entire element can be removed for cleaning.

The invention of Young is inherently slow. Each time the mop or cleaning instrument is returned to the container to remove the dirt particles, the user must wait until all or most of the sediment has settled onto the pad section before dipping the instrument into the liquid. The larger the container, the longer the time for the particles to sink through the liquid onto the pad. Consequently, this invention is not suitable for most cleaning operations, especially commercial window cleaning where time and efficiency are extremely important.

SUMMARY OF THE INVENTION

It is an object of the present invention to provide an efficient and compact multi-purpose bucket or container for use primarily in window cleaning.

It is another object of the invention to provide an efficient yet uncomplicated means of removing substantially all of the dirt and grit particles that have been deposited in the cleaning liquid after their removal from the cleaning instrument during the cleaning process and of trapping the particles in a compartment to ensure the maintenance of cleaner liquid for longer time periods.

It is yet another object of the invention to provide a more efficient and safer cleaning apparatus for transporting and using cleaning instruments, by a container which substantially removes dirt and grit from the cleaning liquid while simultaneously serving as a carrier for cleaning instruments such as handles, channels, sponges, chamois, scrubbers and other tools.

To achieve these and other objects, a flexible diaphragm (such as rubber) having at least one slit through the middle is placed within a bucket or other container such as to create a compartment between the diaphragm and the bottom of the container. The container is then filled with cleaning liquid. During the course of the cleaning process, the dirt and grit collected by the cleaning instrument, along with the residue of liquid, are discharged into the bucket or other container. The particles of such sediment exit through the flexible diaphragm and are deposited on the base of the container. Such particles are trapped within the compartment created between the diaphragm and the base, thereby ensuring cleaner liquid for longer time periods.

In addition, a strap is fitted within the inner circumference of the bucket so as to form channels within which instruments such as handles, scrubbers, poles and scrapers may be stored. The strap is supported so as to maintain the channels in an upright position. The strap is also configured to maintain a sponge holder and wringer for the scrubber.

The sponge holder contains the sponge when it is not in use and is used to evacuate the liquid without the need of squeezing the sponge manually.

When the cleaning instrument is a scrubber, the liquid and attendant dirt and grit adhering thereto as the result of its use is removed by inserting the scrubber into a scrubber wringer located within the bucket assembly. The scrubber itself comprises a handle attached to the actual cleaning instrument called a wand. The wand has angled rings attached to its surface, allowing it to fit snugly into the scrubber wringer. Further, when the scrubber is pushed and pulled up and down in the wringer, the rings cause the wand to twist back and forth, thereby evacuating the dirt, grit and liquid. The majority of the evacuated dirt and grit, along with the liquid, are trapped in the base of the scrubber wringer and prevented from re-entering the bucket itself. When the cleaning instrument is a sponge or other such instrument, the dirt, grit and water is discharged into the bucket, as is any residue from the scrubber. These particles exit through the diaphragm and are trapped in the bottom of the bucket. When the bucket is emptied, the water containing the dirt and grit is also evacuated.

DESCRIPTION OF THE PREFERRED EMBODIMENT

Figure 1:
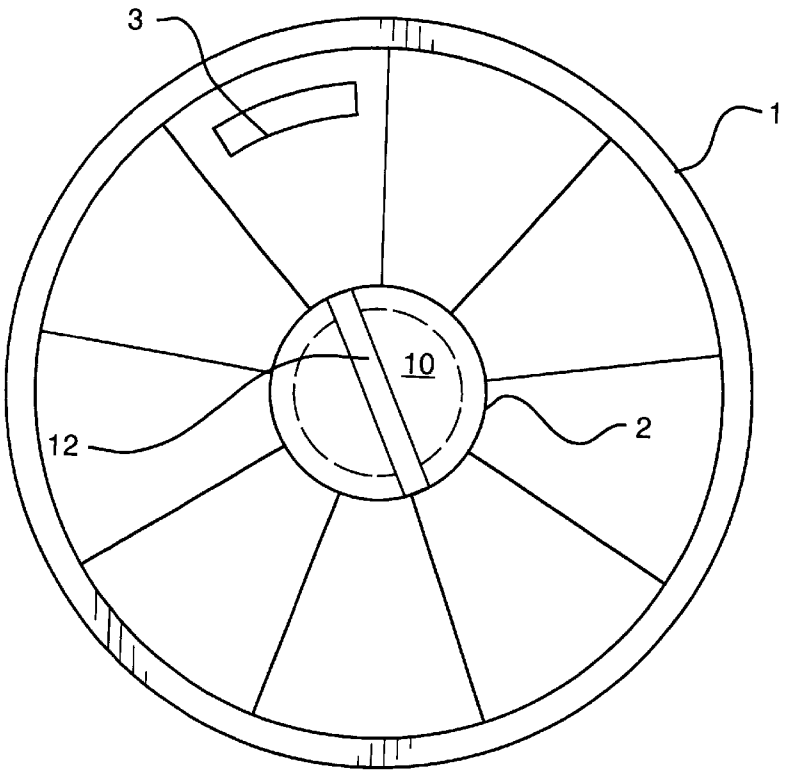
FIG. 1 is a top view of the bucket showing the flexible diaphragm inserted therein.

As shown in FIG. 1, flexible diaphragm 10, having a slit 12 through its mid-section (diameter), is placed within bucket 1 and is configured to fit into bucket 1 so as to create compartment 2 between diaphragm 10 and the bottom of the bucket. The top portion of bucket 1 has slit 3 in its side.

Bucket 1 is filled with cleaning fluid. During the cleaning process, the dirt and grit collected by the sponge, scrubber, or other cleaning instrument are discharged into bucket 1. The majority of particles of sediment from the cleaning instrument, being heavier than the cleaning fluid, sink to the bottom, exit through slit 12 of diaphragm 10 and are deposited on the bottom of bucket 1. Since these particles are in compartment 2 created between diaphragm 10 and the bottom of bucket 1, they are immune to any agitation in the upper portion of bucket 1 and cannot escape through slit 12.

Figure 2:
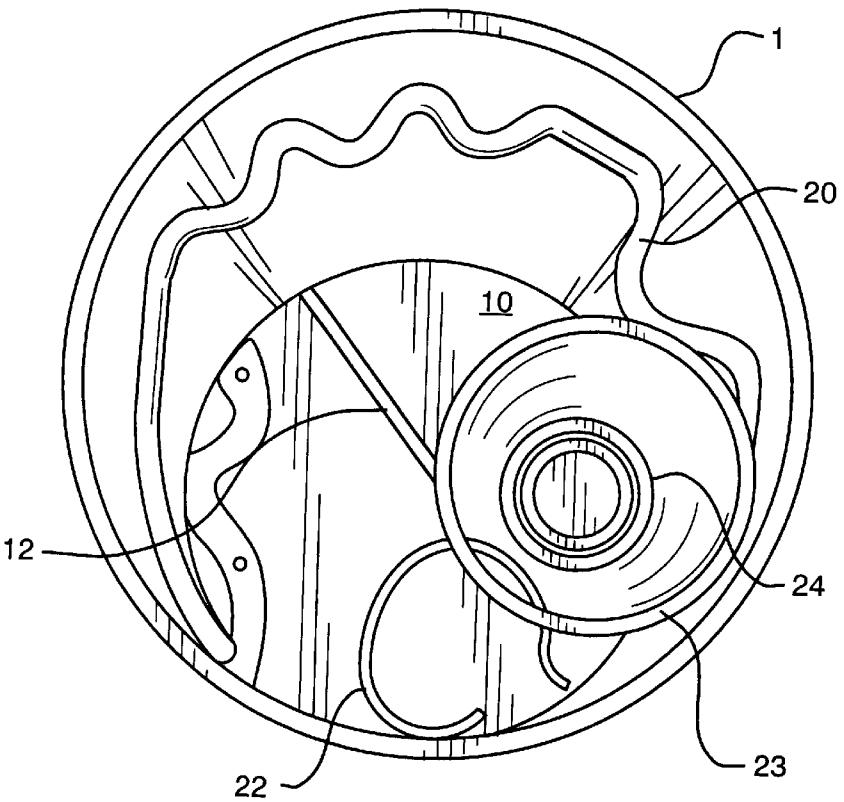
FIG. 2 is a top view of the bucket showing the strap, sponge holder and scrubber wringer, along with the side slit for the chamois.

As shown in FIG. 2, strap 20 is arranged around the circumference of the inside of bucket 1 so as to create openings into which cleaning tools can be inserted for storage. Also held in place by strap 20 and by bottom channel holder 22 is scrubber wringer assembly 23 containing scrubber wringer 24.

Figure 3:
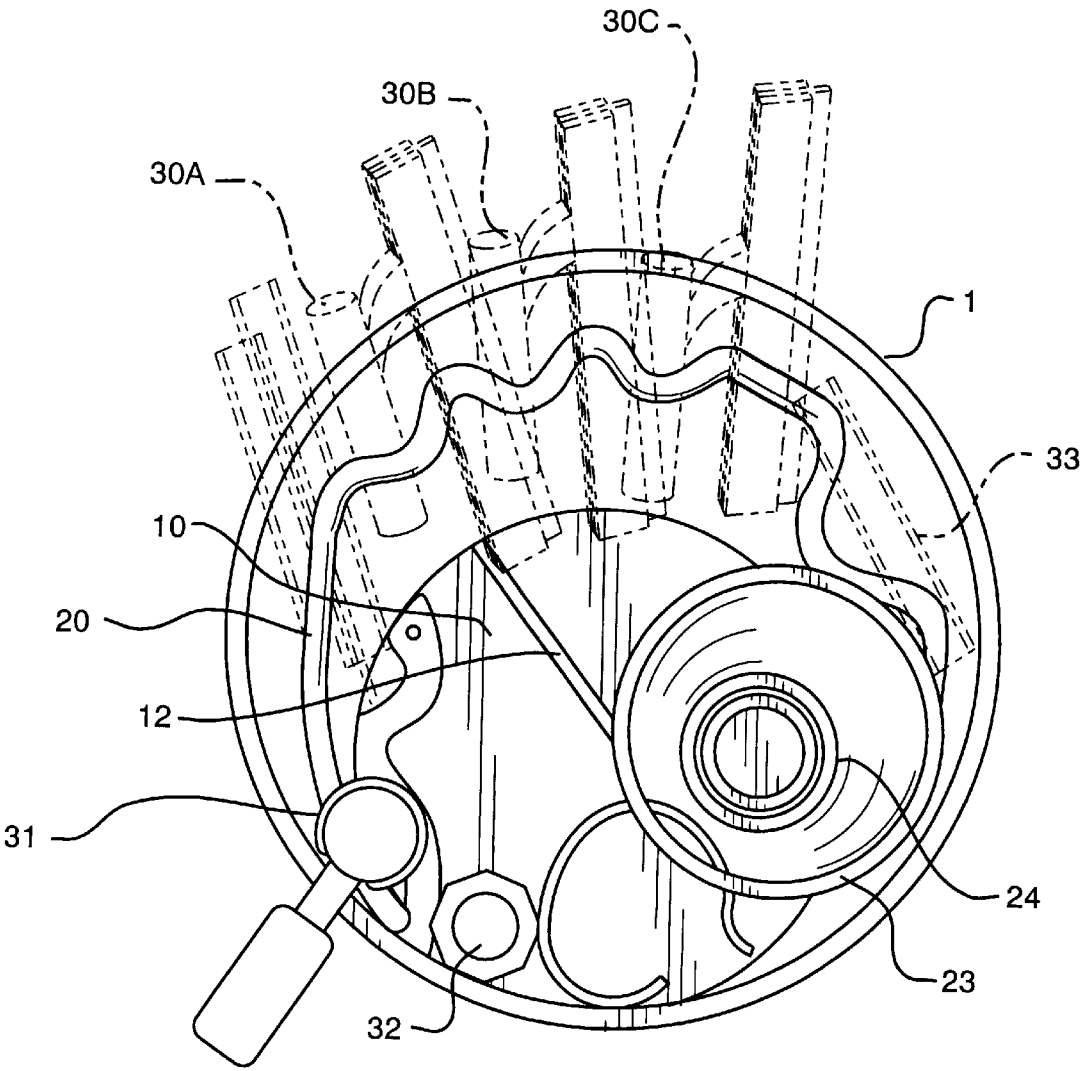
FIG. 3 is a top view of the bucket as fully equipped in the preferred embodiment.

FIG. 3 shows bucket 1 in its fully equipped mode in the preferred embodiment. Inserted in the openings created by strap 20, for example are three (3) handles (squeegees) 30A, 30B, and 30C; scrubber wringer assembly 23, containing scrubber wringer 24; scrubber 31; screwdriver 32; and scrapper 33. Not shown is a sponge which can be placed on top of scrubber wringer assembly 23. Bucket 1 may also have a slit in its side at the top to hold a chamois, of a size such that water in the chamois can be wrung out by pulling the chamois through the slit.

The cleaning process commences by partially filling bucket 1 with the cleaning fluid. As scrubber 31 accumulates grit, it is inserted into scrubber wringer 24 and manually pushed and pulled up and down to remove the grit, which, in turn is trapped in the base of scrubber wringer 24 where it can be evacuated later when the bucket is emptied. Chamois 33 is cleaned by pulling it through slit 3. Whatever grit falls into bucket 1 sinks to the bottom by gravity and evacuates through slit 12 into compartment 2. Likewise, as the other instruments are periodically cleaned by squeezing or wringing them into bucket 1, the resulting grit is also trapped in compartment 2. The overall result is a much cleaner liquid for a longer period than in the prior art. Cleaner liquid, in turn, minimizes window scratching (by grit in the instrument) and allows a more efficient operation.

Figure 4:
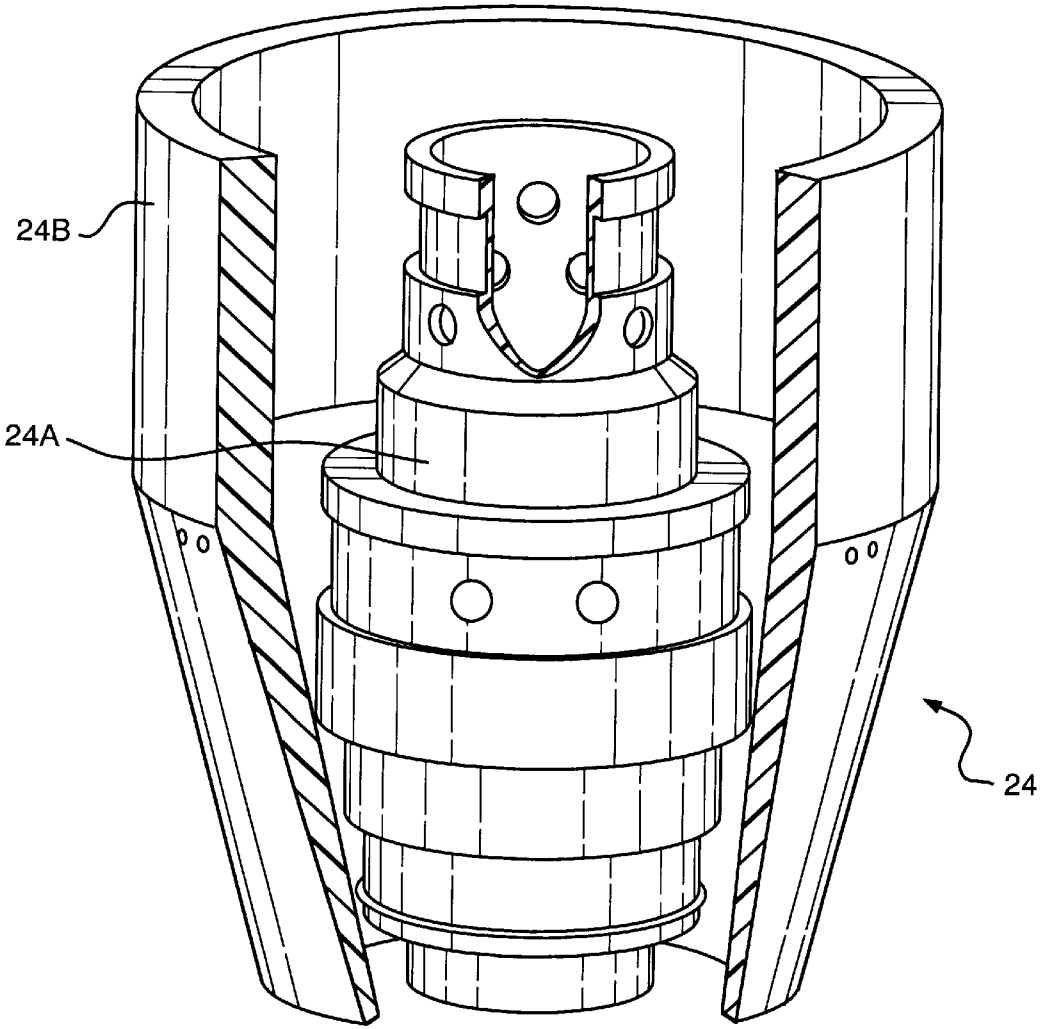
FIG. 4 is a cutaway view of the scrubber wringer assembly, showing the wringer contained within its casing.
Figure 5:
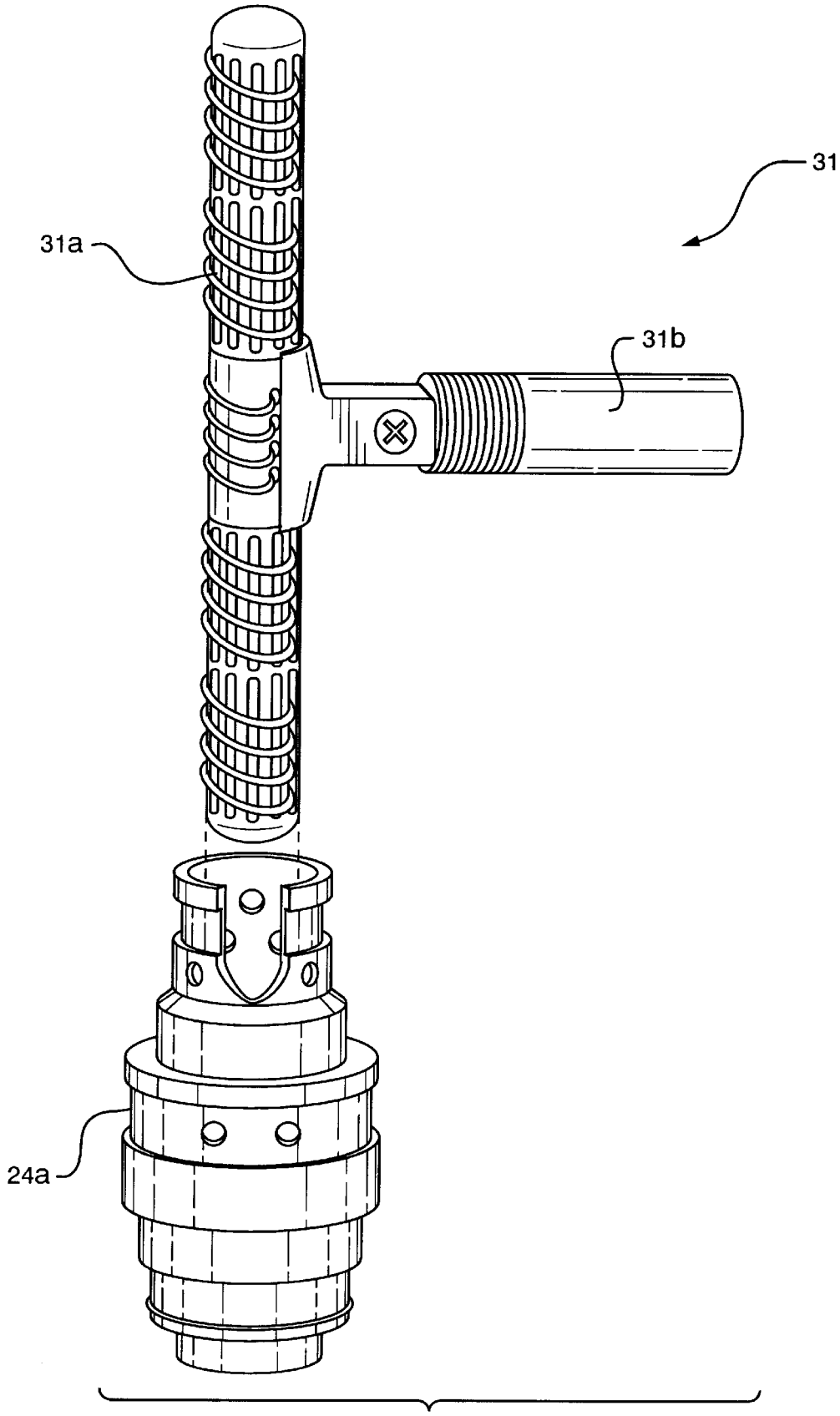
FIG. 5 shows the scrubber relative to the scrubber wringer.

As can be seen in FIGS. 4 and 5, scrubber wringer 24 is conical in shape so that wringer 24A fits snugly into its casing 24B, as shown in FIG. 4. Likewise, as shown in FIG. 5, scrubber 31, which is also conically shaped, fits snugly into wringer 24A. Scrubber 31 has rubber rings 31A attached to its cleaning surface and angled relative to each other so as to push the water as scrubber 31 is pushed and pulled within wringer 24A, causing a twisting action of the scrubber when rubber rings 31A rub against the inside walls of wringer 24A. As a result, scrubber 31 can be efficiently cleaned by the twisting action rather than wringing or squeezing the instrument by hand. This configuration also minimizes water spills because there is no need to clean scrubber 31 by plunging it into the liquid in bucket 1. Such characteristics are especially important when cleaning vertical surfaces such as windows at great heights. As an optional feature scrubber handle 31B may be folded against rings 31A for storage when scrubber 31 is not in use.

In the preferred embodiment, bucket 1 is approximately 14 inches high with an inside circumference of 11.25 inches and outside circumference of 11.75 inches, although any other dimensions would be suitable depending on the size of the platform. Wringer 24A has approximate dimensions of 7.5 inches high, a circumference at the top of 1.25 to 1.50 inches, at the middle of 1.50 to 2.0 inches, and at the bottom of 1.25 inches.

Flexible diaphragm 10 is configured to fit snugly into the bottom of bucket 1. In the preferred embodiment, flexible diaphragm 10 has a circumference of 10.24 inches and a height of 0.75 inch. Slit 12 is approximately 9.75 inches long.

While the invention has been described in its preferred form, it is not limited thereto as to dimensions or instruments.

What is claimed is:

1. Cleaning apparatus for use in a process for cleaning glass or plastic surfaces, comprising:

a bucket having an inner circumference and a bottom, said bucket being adapted to contain cleaning liquids;

a flexible diaphragm insert having at least one slit through a middle thereof and adapted to fit snugly on the bottom of said bucket so as to create a compartment between said diaphragm and the bottom of said bucket;

whereby, dirt and grit collected during the cleaning process sinks by gravity through the cleaning liquid in said bucket, then through said at least one slit into said compartment and is trapped therein.

2. The cleaning apparatus of claim 1 further comprising a strap arranged around said inner circumference of said bucket so as to create holding receptacles for cleaning instruments.

3. The cleaning apparatus of claim 2 further comprising a scrubber having a cleaning instrument, around a surface of which are attached flexible angled rings, and further comprising a scrubber wringer receptacle having an inside wall and tapered in approximately the same shape as said scrubber and affixed to the inside of said bucket, thereby enabling said scrubber to be cleaned by inserting it into said wringer and pushing and pulling it, whereby said rings are caused to move by rubbing against said inner wall at an angle, thereby causing a twisting motion of said cleaning instrument.

* * * * *